US010703608B2

(12) United States Patent
Taudou et al.

(10) Patent No.: US 10,703,608 B2
(45) Date of Patent: Jul. 7, 2020

(54) DETERRENT DEVICE INHIBITION KEY

(71) Applicant: Otis Elevator Company, Farmington, CT (US)

(72) Inventors: Christophe Taudou, La Bussiere (FR); Nicolas Fonteneau, Vitry aux Loges (FR); Clement Schach, Orléans (FR); Thierry Chopineau, Gien (FR); Raphael Picard, Poilly lez Gien (FR); Patrice Degardin, Chatillon sur Loire (FR); Alexandre Renard, Coullons (FR)

(73) Assignee: OTIS ELEVATOR COMPANY, Farminton, CT (US)

( * ) Notice: Subject to any disclaimer, the term of this patent is extended or adjusted under 35 U.S.C. 154(b) by 220 days.

(21) Appl. No.: 15/742,143

(22) PCT Filed: Jul. 13, 2015

(86) PCT No.: PCT/IB2015/001369
§ 371 (c)(1),
(2) Date: Jan. 5, 2018

(87) PCT Pub. No.: WO2017/009679
PCT Pub. Date: Jan. 19, 2017

(65) Prior Publication Data
US 2018/0201479 A1 Jul. 19, 2018

(51) Int. Cl.
*B66B 5/00* (2006.01)
*B66B 13/16* (2006.01)

(52) U.S. Cl.
CPC ..... *B66B 5/0087* (2013.01); *B66B 13/16* (2013.01)

(58) Field of Classification Search
CPC ..... B66B 5/0087; B66B 13/16
See application file for complete search history.

(56) References Cited

U.S. PATENT DOCUMENTS 4,364,454 A * 12/1982 Glaser ..... B66B 13/20 187/314
5,655,627 A * 8/1997 Horne ..... B66B 13/16 187/313

(Continued)

FOREIGN PATENT DOCUMENTS

EP 0892756 A1 1/1999
EP 2623452 A1 8/2013

(Continued)

OTHER PUBLICATIONS

European Office Action, European Application No. 15787662.4, dated Aug. 28, 2019, 5 Pages.

(Continued)

*Primary Examiner* — Michael A Riegelman
(74) *Attorney, Agent, or Firm* — Cantor Colburn LLP

(57) ABSTRACT

An elevator system is provided, the system includes an elevator car (100, 200, 300) having at least one elevator car door (202), a deterrent system configured to prevent the at least one elevator car door (202) from opening when the elevator car (100, 200, 300) is not in an unlocking zone (218, 318), and a disabling system configured to disable the deterrent system such that the at least one elevator car door (202) may be opened outside of the unlocking zone (218, 318).

4 Claims, 4 Drawing Sheets

(56) References Cited

U.S. PATENT DOCUMENTS

| | | | | |
|---|---|---|---|---|
| 5,707,970 | A | 1/1998 | McCarty et al. | |
| 5,819,877 | A * | 10/1998 | Rivera | B66B 13/12 187/314 |
| 6,223,861 | B1 * | 5/2001 | Sansevero | B66B 13/22 187/316 |
| 6,405,834 | B1 * | 6/2002 | Chida | B66B 1/46 187/263 |
| 2008/0047783 | A1 * | 2/2008 | Vogl | B66B 5/0087 187/314 |
| 2013/0327598 | A1 * | 12/2013 | Rebillard | B66B 1/44 187/280 |
| 2014/0076667 | A1 * | 3/2014 | Henseler | B66B 1/466 187/247 |
| 2015/0314991 | A1 * | 11/2015 | Trottman | B66B 11/0246 187/393 |
| 2017/0210600 | A1 * | 7/2017 | Fonteneau | B66B 13/185 |
| 2017/0320704 | A1 * | 11/2017 | Studer | B66B 5/0043 |
| 2017/0341909 | A1 * | 11/2017 | Fonteneau | B66B 13/14 |
| 2018/0186601 | A1 * | 7/2018 | Taudou | B66B 5/0087 |
| 2018/0201479 | A1 * | 7/2018 | Taudou | B66B 13/16 |
| 2018/0327221 | A1 * | 11/2018 | Sudi | B66B 1/3492 |
| 2018/0370762 | A1 * | 12/2018 | Renard | B66B 5/005 |

FOREIGN PATENT DOCUMENTS

| | | | |
|---|---|---|---|
| EP | 2727875 | A1 | 5/2014 |
| JP | H0930747 | A | 2/1997 |
| JP | 2000355471 | A | 12/2000 |
| JP | 2004189365 | A | 7/2004 |
| JP | 2005206346 | A | 8/2005 |
| WO | 0044662 | A1 | 8/2000 |
| WO | 2016012828 | A1 | 1/2016 |

OTHER PUBLICATIONS

International Search Report, International Application No. PCT/IB2015/001369, dated Apr. 8, 2016, European Intellectual Property Office; International Search Report 5 pages.

International Written Opinion, International Application No. PCT/IB2015/001369, dated Apr. 8, 2016, European Intellectual Property Office; Written Opinon 5 pages.

* cited by examiner

DETERRENT DEVICE INHIBITION KEY

CROSS REFERENCE TO RELATED APPLICATIONS

This is a U.S. National Stage of Application No. PCT/IB2015/001369, filed on Jul. 13, 2015, the disclosure of which is incorporated herein by reference.

BACKGROUND

The subject matter disclosed herein generally relates to elevator car door opening systems and, more particularly, to opening elevator car doors when an elevator is not located at a landing.

Elevators may require maintenance to be performed from within an elevator shaft. Accordingly, access must be provided for a technician or other authorized person to gain access to the elevator shaft. Traditional access is provided at each landing of the elevator shaft through a landing door. That is, operation of the landing doors is performed such that the landing doors may be opened when an elevator is not at the particular landing, so that the technician or other authorized person may gain access to the elevator shaft and perform a desired operation. Another form of access to the elevator shaft is by a technician being located on top of an elevator car within the elevator shaft.

Because of safety hazards associated with an elevator shaft, access must be restricted to authorized personnel only. As a result, systems are put in place to prevent and control elevator shaft access, especially for non-authorized persons, in a robust and safe way.

Traditionally, elevator car door systems may be configured with an opening deterrent system or deterrent device that prevents the elevator car doors from opening when not at a landing or unlocking zone and only allows the elevator car doors to be opened at the unlocking zone of a landing. That is, the deterrent system is configured to enable the elevator car doors to open only when a landing door also opens. The space between each landing or unlocking zone is a traveling zone, where a landing door may not be present, and the elevator may move at speed between landing floors. As such, elevator car doors may not be allowed and are prevented from being opened when in the traveling zone. If any portion of an elevator car is outside of the landing or unlocking zone, the elevator car doors are prevented from being opened by the deterrent system.

SUMMARY

According to one embodiment an elevator system is provided. The system includes an elevator car having at least one elevator car door, a deterrent system configured to prevent the at least one elevator car door from opening when the elevator car is not in an unlocking zone, and a disabling system configured to disable the deterrent system such that the at least one elevator car door may be opened outside of the unlocking zone.

In addition to one or more of the features described above, or as an alternative, further embodiments may include an elevator controller configured in communication with the deterrent system and the disabling system, wherein the disabling system is configured to communicate to the controller that the deterrent system is to be disabled and the controller then disables the deterrent system.

In addition to one or more of the features described above, or as an alternative, further embodiments may include at least one sensor configured determine the position of the elevator car within an elevator shaft.

In addition to one or more of the features described above, or as an alternative, further embodiments may include that the disabling system is one of mechanical and electronic.

According to another embodiment, a method of operating an elevator car is provided. The method includes closing at least one elevator car door of an elevator car, disabling a deterrent system, wherein the deterrent system is configured to prevent the at least one elevator car door from opening when the elevator car is outside of an unlocking zone, and opening the at least one elevator car door of the elevator car when the elevator car is outside of the unlocking zone.

In addition to one or more of the features described above, or as an alternative, further embodiments may include entering a maintenance mode prior to disabling the deterring system.

In addition to one or more of the features described above, or as an alternative, further embodiments may include moving the elevator car in an elevator shaft with the at least one elevator car door open.

In addition to one or more of the features described above, or as an alternative, further embodiments may include that disabling the deterrent system comprises entering a sequence into an elevator car operating panel.

In addition to one or more of the features described above, or as an alternative, further embodiments may include that disabling the deterrent system comprises inserting a key into a car operating panel.

In addition to one or more of the features described above, or as an alternative, further embodiments may include that the key is held captive when the deterrent system is disabled.

Technical effects of embodiments of the present disclosure include enabling opening of elevator car doors outside of an unlocking zone. Further technical effects include a modified deterrent system configured to be disabled when an authorized person desires to open an elevator car door without being in an unlocking zone, such that the authorized person may inspect features of an elevator shaft, including landing door components. Further technical effects include enabling maintenance of elevator shaft components from within an elevator car.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
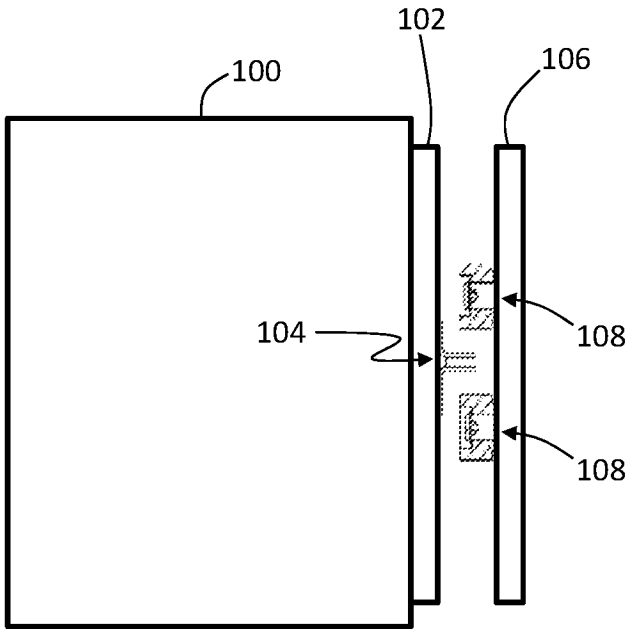
FIG. 1 is a top-down schematic view of an elevator car and landing door.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. 1 may be labeled "1*a*" and a similar feature in FIG. 2 may be labeled "2*a*." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

During operation of an elevator car within an elevator shaft, the elevator car doors and the landing doors are configured to open simultaneously and coact with each other. For example, when an elevator car reaches a floor or landing, the operation of the elevator car door(s) acts upon the landing door(s), such that both sets of doors open and close together. This is achieved by one or more couplings, such as blades, vanes, etc. installed on the exterior or elevator shaft side of one or more elevator car doors. One or more landing door locks are disposed within the elevator shaft. The landing door locks may be configured as locks, rollers, etc. that are configured to coact with the car door coupling such that the doors operate (open/close) in tandem.

To ensure proper door operation, the coupling of the elevator car and the locks of the landing doors must be aligned, and other maintenance operations may be performed on the components within an elevator shaft. The alignment may be necessary so that the opening/closing components of the doors will operate together appropriately. That is, the elevator car doors will operate and open at an unlocking zone. The alignment is also important when an elevator car passes a landing door without stopping. That is, the car door coupling must be able to pass the landing door lock when the elevator car is moving within the elevator shaft without interference or contact between the coupling and the locks. This is merely an example of the features that interact between an elevator car and a landing door, and between an elevator car and other components within an elevator shaft. Those of skill in the art will appreciate that other maintenance operations within an elevator shaft may be necessary for maintaining a properly functioning elevator.

With reference to FIG. 1, a top down view of an elevator car and landing door is shown. The elevator car 100 has a car door 102 which includes a car door coupling 104 and may include one or more car door panels and associated components. On the landing side there is a landing door 106 and a landing door lock 108. The car door coupling 104 and the landing door lock 108 coact to enable the car door 102 and the landing door 106 to operate simultaneously to open and close. As noted above, the car door coupling 104 and the landing door lock 108 must be aligned for proper operation of the elevator system. As shown in FIG. 1, the elevator car 100 is at an unlocking zone, wherein the car door coupling 104 and the landing door lock 108 are proximal to each other and aligned.

Figure 2B:
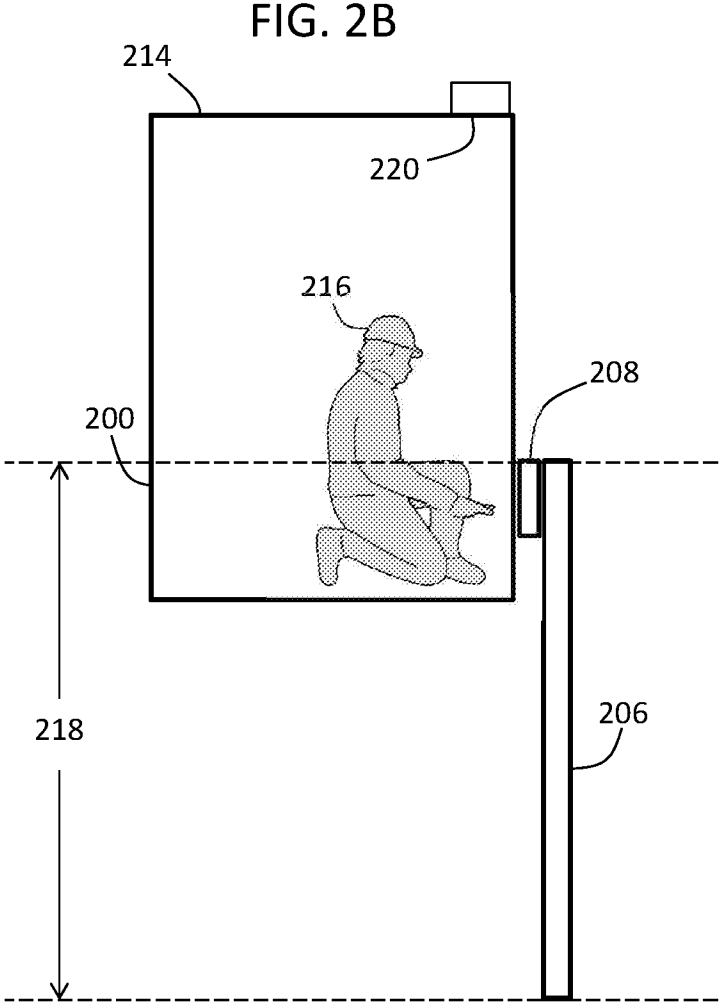
FIG. 2B is a schematic side view of an operation performed in accordance with an embodiment of the disclosure with an elevator car outside of an unlocking zone.
Figure 2A:
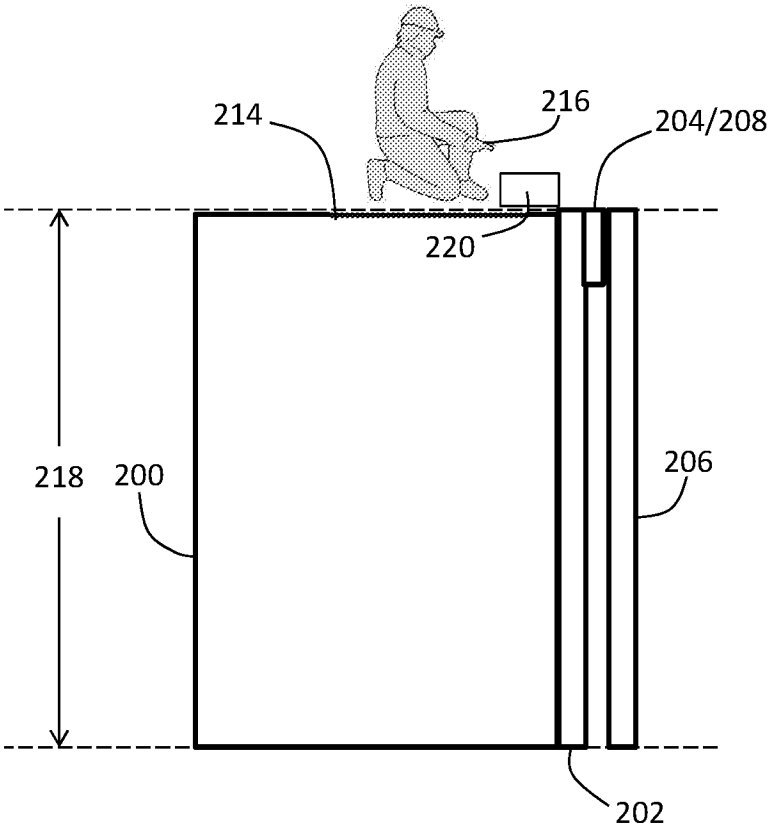
FIG. 2A is a schematic side view of a traditional operation performed during access and maintenance on elevator shaft landing door elements with the elevator car in an unlocking zone.

Referring now to FIGS. 2A and 2B, side view schematic illustrations of maintenance operations of an elevator door coupling are shown. FIG. 2A shows an elevator car 200 having a car door 202 shown relative to a landing door 206 as configured during normal operation such that the doors may be opened together, i.e., showing the elevator car 200 in an unlocking zone 218. Also shown in FIG. 1A is a schematic illustration indicating the traditional method of performing maintenance on components within an elevator shaft. A technician 216 is located on a top 214 of the elevator car 200, which grants access to the components in the elevator shaft, such as landing door lock 208.

FIG. 2B shows an elevator car incorporating an embodiment of the present disclosure, illustrating a user, such as a technician, mechanic, etc., 216 adjusting a landing door lock from inside the elevator car 200. In comparison, as shown in FIG. 2A, the adjustment of the landing door lock was previously made from on top 214 of the elevator car 200 where a technician could visibly see and physically access a car door coupling 204 and a landing door lock 208 at the same time. That is, the technician 216 would access the car door coupling 204 and the landing door lock 208 when the two elements were near or proximal to each other, i.e., in an unlocking zone or landing zone 218.

As such, under prior processes, a technician 216 would be located on the top 214 of the elevator car 200, where the car door coupling 204 and the landing door lock 208 are located such that any adjustments may be made to the landing door lock 208 relative to the car door coupling 204. As shown, the technician 216 would be located within the elevator shaft and outside of the elevator car, i.e., on top of the elevator car. After an adjustment process, the technician 216 would then have to get off the top 214 of the elevator car 200 and then move the elevator car, and then get back on top of it.

The prior process was due, in part, because the elevator car door 202 could only be opened in an unlocking zone 218, shown in FIG. 2A. The unlocking zone 218 is a zone within an elevator shaft wherein the landing door locks and car door couplings are aligned such that the elevator car doors may be opened, also known as a landing zone. However, when outside of the unlocking zone 218, e.g., in a traveling zone, the elevator car doors may be prevented from being opened by means of a deterrent system 220. Because the elevator car doors 202 cannot be opened in traveling zones, or outside of an unlocking zone, the technician is unable to perform any potential maintenance from within the elevator car 200.

However, as shown in FIG. 2B, embodiments disclosed herein enable an elevator car door to be opened outside of an unlocking zone 218, thus allowing a technician 216 to perform a maintenance operation from within the elevator car 200. The technician 216 may access and perform any maintenance operations, including alignment operations, on the landing door lock 208 or other components within the elevator shaft from within the elevator car 200. As shown, in contrast to FIG. 2A, the landing door lock 208 is accessible from inside the elevator car 200, and the elevator car 200 is outside of the unlocking zone 218.

In accordance with embodiments disclosed herein, the deterrent system 220 or similar device is deactivated or disengaged to enable operation of the elevator doors outside of the unlocking zone 218. As shown in FIGS. 2A and 2B, the deterrent system 220 is configured on the top 214 of the elevator car 200. The deterrent system may be an electrical or mechanical system that is configured to prevent the elevator car doors 202 from being opened when the elevator car 200 is not located completely within an unlocking zone 218, as shown in FIG. 2A. That is, if, for example, the elevator car 200 shown in FIG. 2B was not equipped with embodiments described herein, the elevator car doors 202 could not be opened, and the technician 216 could not perform the maintenance operation as shown in FIG. 2B.

However, as shown in FIG. 2B, the technician 216 is able to perform a maintenance operation from inside the elevator car 200. That is, the elevator car 200 is located outside of the unlocking zone 218 but the technician 216 is able to open the elevator car doors 202 and gain access to the landing door lock 208 or other components located within the elevator shaft that are outside of the elevator car 200, while the technician 216 remains within the elevator car 200.

Figure 3:
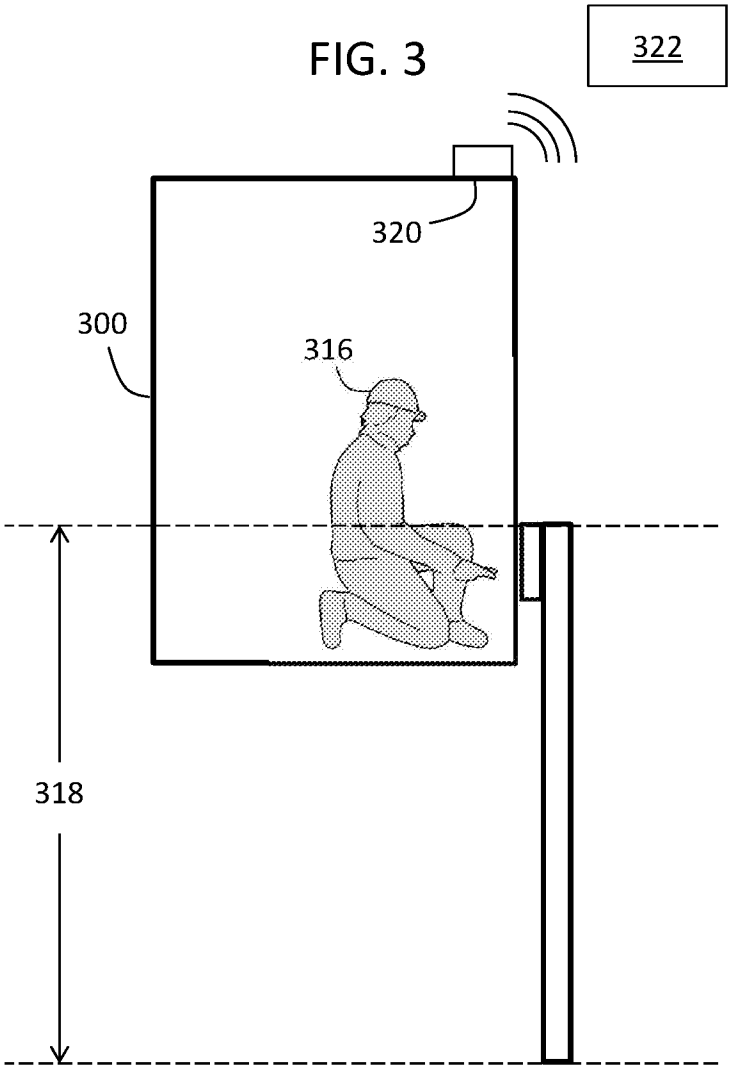
FIG. 3 is a schematic illustration of an elevator system in accordance with an embodiment of the present disclosure.

Turning now to FIG. 3, a system in accordance with the present disclosure is shown. In FIG. 3, an elevator car 300 is configured with a deterrent device inhibition system that enables a technician 316 to disable a deterrent system 320 and permit opening of the elevator car doors when the elevator car 300 is not located within an unlocking zone.

In accordance with embodiments described herein, a technician 316 may operate a device or control sequence that is configured to communicate with a controller 322. In some embodiments, the control sequence may be entered on the car operating panel. In other embodiments a key may be entered into a mechanism on a panel within the elevator car. In other embodiments, the controller 322 may be used to remotely disable the deterrent system 320. The controller 322 may be the controller or control system configured to control the elevator car 300 within an elevator shaft. The controller 322 may be configured in communication, wired or wirelessly, with the deterrent system 320.

In standard or normal operation, the deterrent system 320 is active and configured to prevent the doors of the elevator car 300 to be opened when the elevator car 300 is outside of an unlocking zone 318, as discussed above. However, a technician 316 may enable a mode of operation such that the deterrent system 320 is deactivated or disabled. As noted, the technician 316 may use a physical key in a locking/switch mechanism or may enter a specific code into a touch pad or using the elevator floor buttons to enable the deactivation or disabling of the deterrent system 320. A similar or reverse process may be used for re-activating or re-enabling the deterrent system 320.

In some embodiments, to disable the deterrent system 320, the technician 316 must operate the elevator car 300 such that it stops outside of an unlocking zone 318. In other embodiments, the deactivation or disabling of the deterrent system 320 may be performed within or at an unlocking zone 318. In some embodiments, the deterrent system 320, the elevator car 300, and/or the controller 322 may be configured with sensors or other detection means for determining when an elevator car is within an unlocking zone 318, i.e., position detection methods and mechanisms as known in the art may be employed.

In either case of position of the elevator car 300 for deactivation of the deterrent system 320, to open the elevator car doors to enable the inspection and maintenance of elements within the elevator shaft, the elevator car 300 must be moved outside of an unlocking zone 318. This is because when the elevator car 300 is in the unlocking zone 318, the car door coupling and the landing door lock are aligned and configured to have the landing doors open when the elevator car doors open. To be able to open the elevator car doors without opening the landing doors, the elevator car 300 must be positioned outside of the unlocking zone 318.

By performing the deactivation or disabling of the deterrent device 320, the deterrent device 320 may no longer prevent the car door opening when outside of an unlocking zone and the controller 322 may be switched automatically into an inspection mode. Further, in some embodiments, once the elevator car doors are opened in this mode of operation the elevator car 300 may be moved up and/or down within the elevator shaft such that a technician 316 may be able to perform inspection and/or maintenance operations on all available levels within an elevator shaft.

In some embodiments, if the deactivation operation is mechanical, a deactivation device (e.g., a key) may be kept captive or retained in the mechanism until the car door is returned to the closed position. That is, the mechanical deactivation device may not be removed from a deactivation position unless the elevator car doors are closed. In such embodiments, closing the car door and removing the key may reset the system to a normal operating state or mode.

In other embodiments, for example if the deactivation operation is electronic (e.g., a specific button sequence entered via the car operating panel), the return to the normal state or mode may be achieved when the elevator car doors are closed.

Figure 4:
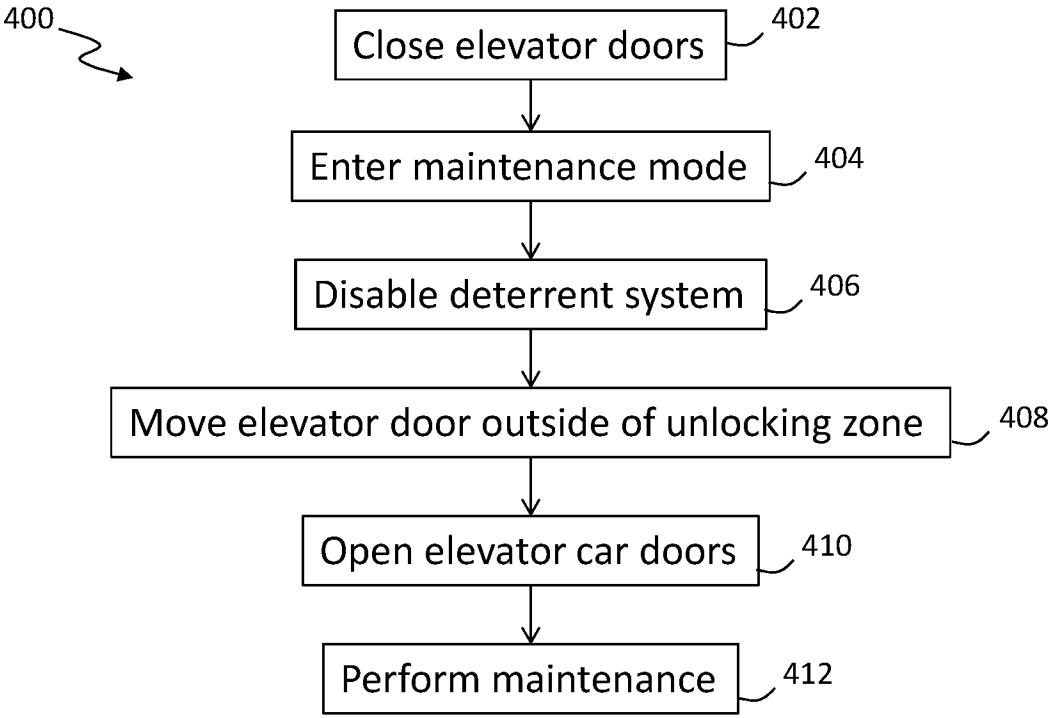
FIG. 4 is a schematic flow chart of a process of operating an elevator in accordance with an embodiment of the present disclosure.

Turning now to FIG. 4, a flow chart of a process in accordance with the present disclosure is shown. Process 400 may be employed in or with elevator systems as described above or with other systems as known in the art. When a technician desires to perform maintenance on elements and components in an elevator shaft from within an elevator car, the technician must disable a deterrent mechanism. The deterrent mechanism, as described above, is configured to prevent the elevator car doors from opening when the elevator is not in an unlocking zone.

At step 402, the elevator doors are closed. This will place the elevator car doors in the closed position. This will generally occur at a landing and within an unlocking zone. With the elevator car doors closed, the system may enter a maintenance mode at step 404. The maintenance mode may be a mode of elevator operation that enables a technician to perform functions that may not be available during normal operation of the elevator.

With the elevator in maintenance mode, the deterrent system of the elevator may be disabled at step 406. Disabling of the deterrent system may involve entering a specific key sequence on a car operating panel, using a specific key, mechanically disabling the system, or other process. In some embodiments the deterrent system may be disabled remotely by commands sent from an elevator controller.

With the deterrent system disabled, the elevator car may be moved outside of the unlocking zone at step 408. When outside of the unlocking zone, the opening components of the elevator car and a landing door are not aligned. Thus, at step 410, the elevator car doors may be opened as the deterrent system is disabled. Because the elevator car is outside of an unlocking zone, when the elevator car doors are opened, there is no landing door to also open. The interior walls of the elevator shaft are thus made available. Maintenance operations, including inspections and repairs, may be performed safely from inside the elevator car.

In this state, in some embodiments, the elevator car may be moved between different locations within the elevator shaft, with the elevator car door open. When the maintenance is complete, the reverse process may be performed to re-enable the deterrent system. For example, the elevator car doors may be closed, the elevator car may be moved to an unlocking zone, the deterrent system may be re-enabled, and a normal operating mode may be activated.

Although a specific order of steps has been described above, those of skill in the art will appreciate that the order of steps may be altered and/or additional steps may be added or some steps omitted, without departing from the scope of the disclosure. For example, step 408 may be performed earlier in the process or an additional step of communicating with a controller may be employed, similar to that described above.

Advantageously, embodiments described herein provide the ability for a technician to perform maintenance that was traditionally performed from on top of an elevator car to be performed from within the elevator car. Further, advantageously, in accordance with some embodiments, the elevator car may be configured to move within the elevator shaft even with the elevator car door open when in the maintenance mode, without the deterrent system interfering with the movement of the elevator car or the opening of the elevator car doors.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

an elevator car having at least one elevator car door configured to be openable when proximate a landing door and within an unlocking zone such that the at least one elevator car door and the landing door are configured to be opened together;

a deterrent system configured to prevent the at least one elevator car door from opening when the elevator car is not in the unlocking zone;

a disabling system configured to disable the deterrent system such that the at least one elevator car door may be opened when the elevator car is not in the unlocking zone; and an elevator controller configured in communication with the deterrent system and the disabling system, wherein the disabling system is configured to communicate to the controller that the deterrent system is to be disabled and the controller then disabled the deterrent system.

2. The system of claim 1, further comprising at least one sensor configured determine the position of the elevator car within an elevator shaft.

3. The system of claim 2, wherein the disabling system is one of mechanical and electronic.

4. The system of claim 1, wherein the disabling system is one of mechanical and electronic.

* * * * *